US009995562B2

(12) United States Patent
Jennett et al.

(10) Patent No.: US 9,995,562 B2
(45) Date of Patent: Jun. 12, 2018

(54) MULTIPLE EXPLOSIVELY FORMED PROJECTILES LINER FABRICATED BY ADDITIVE MANUFACTURING

(71) Applicant: Raytheon Company, Waltham, MA (US)

(72) Inventors: Gaston P. Jennett, Tucson, AZ (US); Kim L. Christianson, Oro Valley, AZ (US); Dmitry V. Knyazev, Tucson, AZ (US); Henri Y. Kim, Tucson, AZ (US); Robert P. Johnson, Tucson, AZ (US)

(73) Assignee: Raytheon Company, Waltham, MA (US)

( * ) Notice: Subject to any disclaimer, the term of this patent is extended or adjusted under 35 U.S.C. 154(b) by 0 days. days.

(21) Appl. No.: 14/966,731

(22) Filed: Dec. 11, 2015

(65) Prior Publication Data

US 2017/0167833 A1 Jun. 15, 2017

(51) Int. Cl.

| | |
|---|---|
| ***F42B 12/32*** | (2006.01) |
| ***F42B 12/22*** | (2006.01) |
| ***F42B 12/76*** | (2006.01) |
| ***F42B 33/00*** | (2006.01) |
| *F42B 1/028* | (2006.01) |
| *F42B 1/032* | (2006.01) |

(52) U.S. Cl.
CPC ..... *F42B 12/32* (2013.01); *F42B 12/22* (2013.01); *F42B 12/76* (2013.01); *F42B 33/00* (2013.01); *F42B 1/028* (2013.01); *F42B 1/032* (2013.01)

(58) Field of Classification Search
CPC ..... F42B 1/028; F42B 1/032; F42B 12/02; F42B 12/20; F42B 12/22; F42B 12/32; F42B 12/76; F42B 33/00
USPC ..... 102/306–310, 494–496
See application file for complete search history.

(56) References Cited

U.S. PATENT DOCUMENTS

| | | | | |
|---|---|---|---|---|
| 3,799,054 | A * | 3/1974 | LaRocca | F42B 12/22 102/491 |
| 4,649,828 | A | 3/1987 | Henderson et al. | |
| 4,982,667 | A | 1/1991 | Weimann | |
| 4,982,668 | A * | 1/1991 | Bender | F42B 12/32 102/495 |
| 5,191,169 | A | 3/1993 | Hu | |
| 5,509,357 | A | 4/1996 | Lawther | |
| 5,540,156 | A | 7/1996 | Fong | |
| 5,709,265 | A | 1/1998 | Haugen et al. | |
| 5,792,980 | A | 8/1998 | Weimann | |
| 6,186,070 | B1 | 2/2001 | Fong et al. | |
| 6,308,634 | B1 | 10/2001 | Fong | |
| 6,510,797 | B1 | 1/2003 | Fong | |
| 6,606,951 | B1 | 8/2003 | Klein | |
| 6,619,210 | B1 | 9/2003 | Spivak et al. | |
| 6,668,727 | B1 | 12/2003 | Kim et al. | |
| 6,868,791 | B1 | 3/2005 | Thompson et al. | |

(Continued)

OTHER PUBLICATIONS

International Search Report and Written Opinion for corresponding International Application No. PCT/US2016/040408 dated Mar. 10, 2017.

*Primary Examiner* — James S Bergin
(74) *Attorney, Agent, or Firm* — Renner, Otto, Boisselle & Sklar, LLP

(57) ABSTRACT

A liner includes a plurality of individual projectile cells and a web of joining material holding the plurality of projectile cells in a monolithic and continuous structure. The liner is cylindrical and formed of an additive manufacturing process.

17 Claims, 2 Drawing Sheets

(56) References Cited

U.S. PATENT DOCUMENTS

| | | | | |
|---|---|---|---|---|
| 7,093,542 | B2 * | 8/2006 | Gousman | F42B 12/22 102/493 |
| 7,261,036 | B2 * | 8/2007 | Bourne | F42B 1/032 102/306 |
| 7,614,348 | B2 * | 11/2009 | Truitt | F42B 12/50 102/491 |
| 8,176,849 | B1 * | 5/2012 | Gold | F42B 12/32 102/491 |
| 8,434,411 | B2 | 5/2013 | Daoud et al. | |
| 8,813,651 | B1 | 8/2014 | Hooke | |
| 8,978,558 | B2 * | 3/2015 | Lumley | F42B 1/036 102/307 |
| 9,291,437 | B2 * | 3/2016 | Bonnstetter | F42B 12/24 |
| 9,541,363 | B2 * | 1/2017 | Burky | F42B 12/22 |
| 2007/0240599 | A1 | 10/2007 | Pratt et al. | |
| 2014/0230682 | A1 | 8/2014 | Bonnstetter et al. | |

* cited by examiner

MULTIPLE EXPLOSIVELY FORMED PROJECTILES LINER FABRICATED BY ADDITIVE MANUFACTURING

FIELD OF THE INVENTION

The invention relates to explosively formed projectiles or penetrators and more particularly to methods of making liners for explosively formed projectiles.

DESCRIPTION OF THE RELATED ART

Multiple explosively formed projectile (MEFP) warhead liners are typically made of arrays of individual explosively formed projectile cells fabricated from a dense and ductile material. When the MEFP warhead is detonated, explosive energy is released to shape the liner and transform the liner into a projectile. Conventional liners are formed of manufacturing processes such as machining, roll stamping, die forming, and hydro forming. However, the aforementioned manufacturing processes may be limiting in producing liners that have a more complex geometry or have a higher yield point than forming capacity. Attempts to use conventional manufacturing processes to form explosively formed projectiles with complex geometries may result in the projectiles being malformed and misdirected, or having holes. Thus, the overall efficiency of the warhead or weapon is reduced.

SUMMARY OF THE INVENTION

A liner according to the present invention includes a plurality of individual projectile cells and a web of joining material holding the plurality of projectile cells in a monolithic and continuous structure. The liner is cylindrical and has a single surface without voids. The liner is formed of an additive manufacturing process to achieve the disclosed geometry that would be unachievable by conventional manufacturing processes.

According to an aspect of the invention, a liner includes: a plurality of individual projectile cells; and a web of joining material holding the plurality of projectile cells in a monolithic structure. The liner is cylindrical and a continuous structure.

Each of the plurality of individual projectile cells may be formed of a first metal and the web of joining material may be formed of a metal alloy of the first metal and a second metal.

The liner may be a tessellated structure. Each of the individual projectile cells may have a hexagonal cross section. Each of the individual projectile cells may have a diameter between 5 and 100 micrometers.

The liner may be made by an additive manufacturing process. The liner may be made by direct metal laser sintering. The liner may be made by radio frequency micro-induction welding.

The liner may be made of an alloy of copper, silver, nickel, tantalum, molybdenum, platinum, or steel.

The liner may be in an explosive device, such as in a munition.

According to an aspect of the invention, an explosive device includes: a liner that has a plurality of individual projectile cells and a web of joining material holding the projectile cells in a monolithic structure; and an explosive material within the liner. The liner is cylindrical and the projectile cells are propelled radially outwardly when the explosive material is detonated.

The explosive device may be cylindrical and the liner may be concentric with the explosive device.

Each of the individual projectile cells may have a diameter between 5 and 100 micrometers.

The liner in the explosive device may be a continuous structure. The liner may be a tessellated structure.

The liner in the explosive device may be made by an additive manufacturing process. The liner may be made by direct metal laser sintering or radio frequency micro-induction welding.

The liner in the explosive device may be made of a metal alloy of copper, silver, nickel, tantalum, molybdenum, platinum, or steel.

To the accomplishment of the foregoing and related ends, the invention comprises the features hereinafter fully described and particularly pointed out in the claims. The following description and the annexed drawings set forth in detail certain illustrative embodiments of the invention. These embodiments are indicative, however, of but a few of the various ways in which the principles of the invention may be employed. Other objects, advantages and novel features of the invention will become apparent from the following detailed description of the invention when considered in conjunction with the drawings.

BRIEF DESCRIPTION OF DRAWINGS

The annexed drawings, which are not necessarily to scale, show various aspects of the invention.

DETAILED DESCRIPTION

A liner according to the present invention includes a plurality of individual projectile cells and a web of joining material holding the plurality of projectile cells in a monolithic and cylindrical structure. The liner is fabricated as a single continuous surface with no voids. The liner is formed of an additive manufacturing process to achieve the disclosed geometry.

Figure 1:
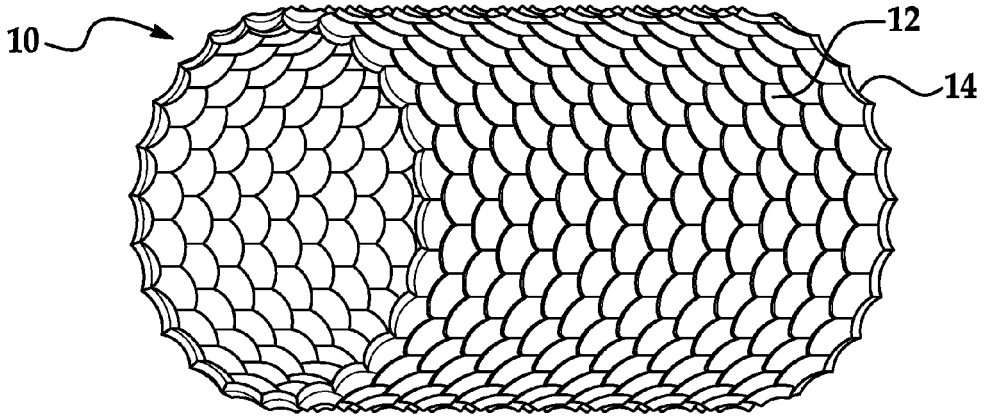
FIG. 1 is a perspective view of a liner in accordance with an exemplary embodiment of the invention.
Figure 2:
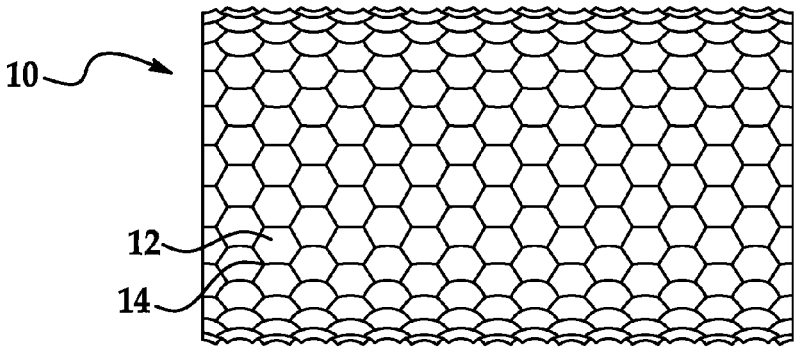
FIG. 2 is a top view of the liner of FIG. 1.
Figure 3:
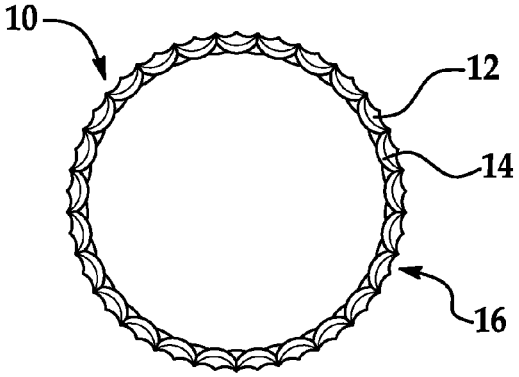
FIG. 3 is a side view of the liner of FIG. 1.

FIG. 1 is a perspective view of a liner 10 according to the present application. The liner 10 has a single surface that is continuous and cylindrical. The liner 10 is formed of a plurality of individual projectile cells 12 held together in a monolithic structure by a web of joining material 14. FIG. 2 is a top view of the cylindrical liner 10 and FIG. 3 is a side view of the cylindrical liner 10.

Each of the individual projectile cells 12 may be directly fabricated in a predetermined orientation, such as in an array 16. As best shown in FIG. 3, each of the individual projectile cells 12 in the array 16 may be positioned at a slight angle relative to one another to form the liner 10 having a tightly curved shape. The angle between each of the individual cells 12 may be less than 45 degrees and allows the liner 10 to have a single continuous surface formed of the projectile cells 12 without having cracks or pinch points between edges of each of the cells 12. The liner 10 is formed without voids between each of the individual cells 12.

The structure of the liner 10 may further include a plurality of depressions that are defined by the individual projectile cells 12 held together by the web of joining material 14. The liner 10 may be fabricated from materials that are ductile and dense. Suitable materials include metallic alloys of copper, silver, nickel, tantalum, molybdenum, platinum, and steel. A suitable alloy may be 316L stainless steel. The alloy may be formed of suitable metals that form a homogeneous solid solution or a single phase binary alloy, such that the metals have the same atomic structure and atoms of both metals occupy positions on the same lattice structure to form the solid solution. The liner 10 may be formed of a copper and nickel alloy. The individual projectile cells 12 may be formed of copper and the web of joining material 14 may be formed of a nickel and copper alloy, such that the projectile cells 12 of pure copper are dispersed throughout an alloy matrix that is a continuous phase of the nickel and copper. The projectile cells 12 may be a discrete phase within the alloy matrix. A variety of suitable alloys are possible, and the aforementioned materials (a copper and nickel alloy, for example) should not be considered as necessary essential materials.

Each of the individual projectile cells 12 may be directly fabricated in a predetermined size, shape, and thickness. The individual projectile cells 12 may be generally disc shaped and may have a hexagonal cross section. The liner 10 may be a tessellated structure, where the edges of each hexagonal face engage those of adjacent cells. Each projectile cell 12 may have a variable diameter and thickness that depend on the desired length and mass of the formed projectile.

Figure 4:
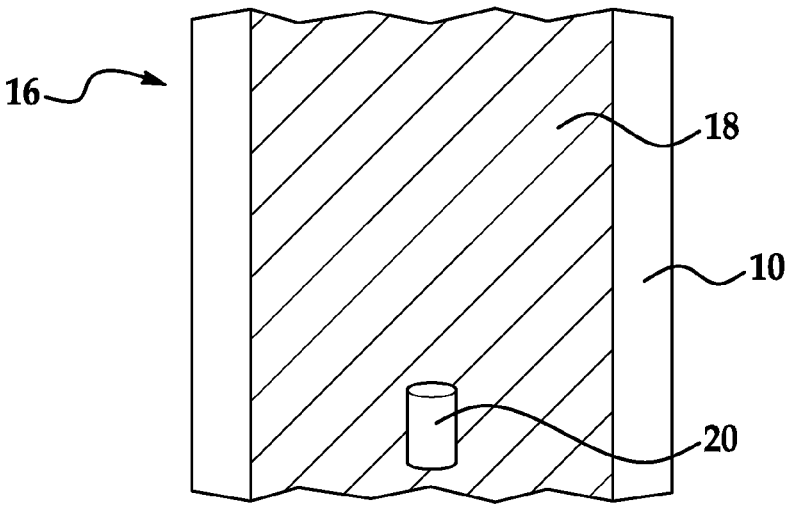
FIG. 4 is a schematic drawing of an explosive device containing the liner of FIG. 1.
Figure 5:
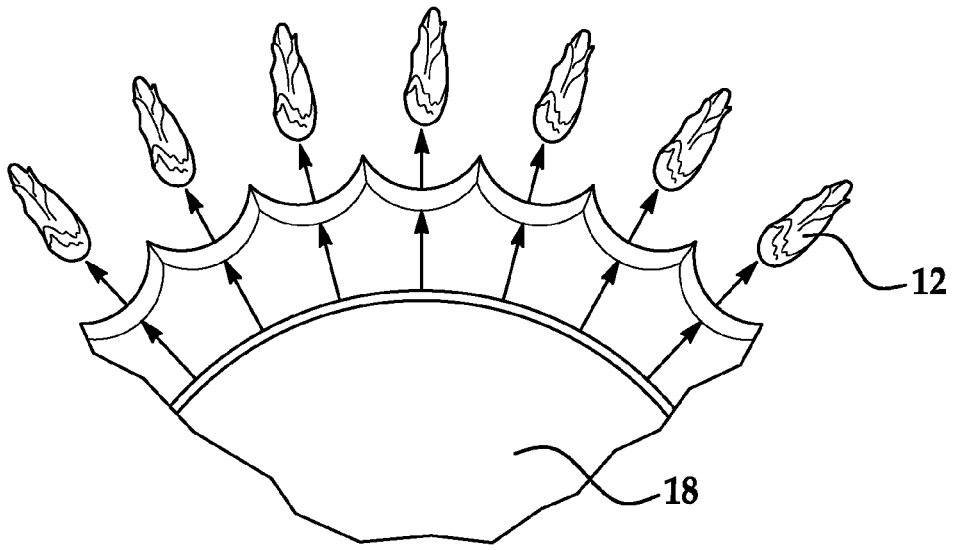
FIG. 5 is a schematic drawing of the liner of FIG. 1 after detonation of the explosive device.

Referring in addition to FIGS. 4 and 5, the liner 10 may be used in an explosive device 16 that includes an explosive material 18 inside the cylindrical structure of the liner 10. The explosive device 16 may be cylindrical and the liner 10 may be concentric with the explosive device 16. The liner may have a thickness between 3% and 5% of the diameter of the explosive material 18. The explosive device 16 may be a munition or part of a munition, such as a warhead. The explosive material 18 may be of a variety of suitable explosives that are used in munitions. The explosive device 16 may include a detonator 20. When the explosive material 18 is detonated by the detonator 20, the liner 10 breaks such that the individual projectile cells 12 break up into small particles and are propelled radially outwardly from the device 16, as shown in FIG. 5. The detonator 20 may include an initiator or booster that is operatively coupled to the explosive material 18 in any of a variety of suitable ways.

The projectile cells 12 may be a solid metal before detonation and a plastically deformed metal when projected. The projectile cells may be projected at a velocity above 2 kilometers per second. The projected projectile cells 12 may have an elongated body relative to the solid projectile cells 12, having a length to body diameter ratio between 1 to 5 or greater. Each of the projectile cells 12 may have substantially the same shape and size. The web of joining material between each of the projectile cells 12 may have a thickness that is less than ⅓ of the total thickness of the liner 10, allowing the web of joining material to be easily broken by the outward force on the liner 10 from the detonation of the explosive material 18.

The liner 10 may be manufactured using an additive manufacturing process, where the liner 10 is built up layer by layer. The liner 10 may be formed of an additive manufacturing process of a powder feedstock comprising a plurality of pure metal particles formed of a first metal that are coated in a second metal. During the additive manufacturing process, the particles are heated such that the pure metal particles partially dissolve in the second metal to form an alloy matrix of the first metal and the second metal. The undissolved portions of the pure metal particles are dispersed throughout the matrix as a discrete phase, that form the projectile cells to be projected upon detonation of the explosive material 18 within the liner 10. The liner 10 may be fabricated by additive manufacturing using a metal alloy, such as 316L stainless steel.

The additive manufacturing process may include direct metal laser sintering or radio frequency micro-induction welding. Other additive manufacturing processes may be used alternatively, or in addition, in making the liner 10. The additive manufacturing process may further include post-fabrication annealing to increase isotropic properties and ductility. The size and form of the additive materials are dependent upon the manufacturing equipment and specific process. In certain applications, the liner may be fabricated by additive manufacturing using low density plastics and nonmetallic materials of lower densities.

The liner as described above is advantageous over previously used liners. One advantage is that the shape, size, and orientation of the individual projectile cells may be controlled to optimize the effectiveness of the warhead in which the liner is used. The warhead liner is not restricted to conventional shapes such as cylinders, spheres, or shapes that allow access of machine tooling or cutting devices. The shape of the liner according to the present application also allows the liner to be used in warheads having complex symmetries or asymmetric designs.

Another advantage is that the liner having a continuous surface for the explosive fill may reduce fabrication complexity and cost by eliminating the need to seal cracks and pinch points that have an adverse impact on explosive safety. Initiation points and other features of the warhead can be manufactured directly in the liner without disrupting the pattern of the liner due to manufacturing defects, such as voids, or uncontrolled edge effects at the individual cell boundaries The liner according to the present application may also be used in heavy vehicles or aircrafts, such as those equipped with armor on vulnerable components and systems. The liner may also be used in commercial applications including perforating down-hole well casings, fracturing hard rock for tunneling, caving charges for mining, decommissioning tunnels, breaching charges, and penetrating bank vaults.

Although the invention has been shown and described with respect to a certain preferred embodiment or embodiments, it is obvious that equivalent alterations and modifications will occur to others skilled in the art upon the reading and understanding of this specification and the annexed drawings. In particular regard to the various functions performed by the above described elements (components, assemblies, devices, compositions, etc.), the terms (including a reference to a "means") used to describe such elements are intended to correspond, unless otherwise indicated, to any element which performs the specified function of the described element (i.e., that is functionally equivalent), even though not structurally equivalent to the disclosed structure which performs the function in the herein illustrated exemplary embodiment or embodiments of the invention. In addition, while a particular feature of the invention may have been described above with respect to only one or more of several illustrated embodiments, such feature may be combined with one or more other features of the other embodiments, as may be desired and advantageous for any given or particular application.

What is claimed is:

1. An explosive device comprising:

a liner that has a plurality of individual projectile cells and a web of joining material between the projectile cells, holding the projectile cells in a monolithic structure; and an explosive material;

wherein the liner is cylindrical and the projectile cells are propelled radially outwardly when the explosive material is detonated;

wherein the explosive material is radially inward of the liner; and wherein the web has a thickness that is less than a thickness of the liner, wherein each of the plurality of individual projectile cells is formed of a first metal and the web of joining material is a metal alloy of the first metal and a second metal.

2. The explosive device according to claim 1, wherein the explosive device is cylindrical and the liner is concentric with the explosive device.

3. The explosive device according to claim 1, wherein each of the individual projectile cells has a diameter between 5 and 100 micrometers.

4. The explosive device according to claim 1, wherein the liner is a continuous structure.

5. The explosive device according to claim 1, wherein the liner is a tessellated structure.

6. The explosive device according to claim 1, wherein the liner is made by an additive manufacturing process.

7. The explosive device according to claim 6, wherein the liner is made by direct metal laser sintering or radio frequency micro-induction welding.

8. The explosive device according to claim 1, wherein one or both of the cells and the web are made of a metal alloy of copper, silver, nickel, tantalum, molybdenum, or platinum, or steel.

9. The explosive device according to claim 1, wherein the thickness of the web is less than ⅓ of the thickness of the liner.

10. The explosive device according to claim 1, wherein detonation of the explosive material breaks the web, separating the projectile cells of the liner.

11. The explosive device according to claim 1, wherein the liner has a thickness between 3% and 5% of a diameter of the explosive material.

12. An explosive device comprising:

a liner that has a plurality of individual projectile cells and a web of joining material between the projectile cells, holding the projectile cells in a monolithic structure; and an explosive material;

wherein the liner is cylindrical and the projectile cells are propelled radially outwardly when the explosive material is detonated;

wherein the explosive material is radially inward of the liner; and wherein detonation of the explosive material breaks the web, separating the projectile cells of the liner, wherein each of the plurality of individual projectile cells is formed of a first metal and the web of joining material is a metal alloy of the first metal and a second metal.

13. The explosive device according to claim 12, wherein the thickness of the web is less than ⅓ of the thickness of the liner.

14. The explosive device according to claim 12, wherein the explosive device is cylindrical and the liner is concentric with the explosive device.

15. The explosive device according to claim 12, wherein each of the individual projectile cells has a diameter between 5 and 100 micrometers.

16. The explosive device according to claim 12, wherein the liner is a continuous structure.

17. The explosive device according to claim 12, wherein the liner is a tessellated structure.

* * * * *